US005933112A

United States Patent [19]

Hiramatsu et al.

[11] Patent Number: 5,933,112

[45] Date of Patent: Aug. 3, 1999

[54] ANTENNA ARRAY RECEIVER AND A METHOD OF CORRECTING A PHASE SHIFT AMOUNT OF A RECEIVING SIGNAL

[75] Inventors: Katsuhiko Hiramatsu, Yokosuka; Kazuyuki Miya, Kawasaki, both of Japan

[73] Assignee: Matsushita Electric Industrial Co., Ltd., Osaka, Japan

[21] Appl. No.: 09/082,461

[22] Filed: May 21, 1998

[30] Foreign Application Priority Data

May 30, 1997 [JP] Japan ..... 9-158126

[51] Int. Cl.[6] ..... H01Q 3/22; H01Q 3/24; H01Q 3/26

[52] U.S. Cl. ..... 342/372; 342/157; 342/92; 342/81

[58] Field of Search ..... 342/372, 157, 342/92, 81

[56] References Cited

U.S. PATENT DOCUMENTS 5,412,414 5/1995 Ast et al. ..... 342/174

5,666,124 9/1997 Chethik et al. ..... 342/383

OTHER PUBLICATIONS

D. Gerlach et al., entitled "Adaptive Transmitting Antenna Arrays with Feedback", at pp. 150–152 of IEEE Signal Processing Letters, vol. 1, No. 10, Oct. 1994.

*Primary Examiner*—Theodore M. Blum
*Attorney, Agent, or Firm*—Greenblum Electric Industrial Co., Ltd.

[57] ABSTRACT

First and second phase control amount tables output to first and second vector multiply circuits phase control signals Sc1 and Sc2 representative of corresponding phase shift amounts with gains represented by input gain control signals Sg1 and Sg2 as arguments. The first and second vector multiply circuits shift the phases of in-phase components S13 and S23 and quadrature components S14 and S24 of an antenna 2 in opposite directions in accordance with the phase control signals Sc1 and Sc2. Consequently, the amount of phase shift caused by receiving amplifiers is corrected so that the phase difference at antenna terminals between the input signals to the antennas is maintained.

34 Claims, 13 Drawing Sheets

GAIN VERSUS PHASE SHIFT AMOUNT
CHARACTERISTIC OF FREQUENCY f1

GAIN VERSUS PHASE SHIFT AMOUNT
CHARACTERISTIC OF FREQUENCY f2

GAIN VERSUS PHASE SHIFT AMOUNT
CHARACTERISTIC OF TEMPERATURE T1

GAIN VERSUS PHASE SHIFT AMOUNT
CHARACTERISTIC OF TEMPERATURE T2

GAIN VERSUS PHASE SHIFT AMOUNT CHARACTERISTIC OF FREQUENCY f1 AND TEMPERATURE T1

GAIN VERSUS PHASE SHIFT AMOUNT CHARACTERISTIC OF FREQUENCY f2 AND TEMPERATURE T1

GAIN VERSUS PHASE SHIFT AMOUNT CHARACTERISTIC
OF FREQUENCY f1 AND TEMPERATURE T2

GAIN VERSUS PHASE SHIFT AMOUNT CHARACTERISTIC
OF FREQUENCY f2 AND TEMPERATURE T2

| | | TEMPERATURE | |
|---|---|---|---|
| | | T1 | T2 |
| FREQUENCY | f1 | (a11、b11、c11) | (a12、b12、c12) |
| | f2 | (a21、b21、c21) | (a22、b22、c22) |

ANTENNA ARRAY RECEIVER AND A METHOD OF CORRECTING A PHASE SHIFT AMOUNT OF A RECEIVING SIGNAL

BACKGROUND OF THE INVENTION

1. Field of the Invention

The present invention relates to an antenna array receiver for performing reception by use of an antenna array.

The present invention also relates to a method of correcting a phase shift amount of a receiving signal.

2. Description of the Related Art

Conventionally, in order to perform directional reception by use of an antenna array, a receiver is designed so as to perform reception while maintaining the phase difference at the antenna terminals among receiving signals from a plurality of antennas.

FIG. 1 shows an example of the antenna array receiver.

First, receiving signals S1 and S2 at antennas 1301 and 1302 are amplified by receiving amplifiers 1303 and 1304. Then, the signals are multiplied by a signal from an oscillator 1307 by mixers 1305 and 1306 and a lower-frequency signal is extracted by band-pass filters (BPFs) 1308 and 1309. At quadrature demodulators 1310 and 1311, quadrature demodulation is performed by use of a signal from an oscillator 1312, and in-phase components S11 and S21 and quadrature components S12 and S22 are output. These output signals are converted into digital values by A/D converters 1313, 1314, 1315 and 1316, and output to an adaptive antenna array receiving circuit 1317.

At RSSI detect circuits 1318 and 1319, the lower-frequency signal extracted by the BPFs 1308 and 1309 is monitored and the levels of the receiving signals are detected. In accordance with the receiving signal levels, the gains of the receiving amplifiers 1303 and 1304 are controlled by gain control circuits 1320 and 1321.

In wireless communication, the levels of receiving signals vary with time. Particularly, in a mobile communication environment, the levels of receiving signals largely vary in a short period of time due to fading, variation in propagated distance and shadowing because of buildings and the like.

In the above-described conventional antenna array receiver, by controlling the gains of the receiving amplifiers 1303 and 1304 by the RSSI detect circuits 1318 and 1319 and the gain control circuits 1320 and 1321, the receiving signal levels are corrected to thereby optimize the input to the A/D converter.

However, generally, the phase shift amount of a receiving amplifier varies according to the gain thereof. The amount of the phase variation differs among receiving amplifiers. The phase shift amount varies according to the frequency and the temperature of the receiving amplifier. The electric length, i.e. the length converted into a wavelength, varies according to the frequency.

For this reason, according to the above-described conventional configuration, the phase difference at the antenna terminals between the receiving signals of the antennas cannot be maintained constant.

SUMMARY OF THE INVENTION

One object of the present invention is to provide an antenna array receiver in which receiving signals can be input to a receiving circuit with the phase difference at the antenna terminals between the receiving signals of the antennas being maintained.

Another object of the present invention is to provide a method of correcting phase shift amounts of receiving signals in which the receiving signals can be input to a receiving circuit with the phase difference at the antenna terminals between the receiving signals of the antennas being maintained.

The present invention provides an antenna array receiver comprising:

a plurality of antenna element constituting an antenna array;

receiving amplifiers, respectively connected to said antenna elements, for amplifying receiving signals from said antenna elements;

phase control amount deciding means for deciding phase control amounts of said receiving signals corresponding to gains of said receiving amplifiers based on gain versus phase shift amount characteristics of said receiving amplifiers; and phase shift amount correcting means for correcting phase shift amounts of said receiving signals by use of the phase control amounts decided by said phase control amount deciding means.

The present invention provides a method of correcting a phase shift amount of a receiving signal, comprising the steps of:

obtaining gains of receiving amplifiers for amplifying receiving signals from a plurality of antenna element constituting an antenna array;

deciding phase control amounts of said receiving signals corresponding to the gains of said receiving amplifiers based on gain versus phase shift amount characteristics of said receiving amplifiers; and correcting a phase shift amount of said receiving signals by use of said decided phase control amounts.

The present invention provides an antenna array receiver comprising:

a plurality of antenna element constituting an antenna array;

receiving amplifiers, respectively connected to said antenna elements, for amplifying receiving signals from said antenna elements;

phase control amount deciding means for deciding phase control amounts of said receiving signals corresponding to gains of said receiving amplifiers based on gain versus phase shift amount characteristics of said receiving amplifiers; and phase shift amount correcting means for correcting the phase shift amounts of said receiving signals based on offset control information of a frequency.

The present invention provides an antenna array receiver comprising:

a plurality of antenna element constituting an antenna array;

receiving amplifiers, respectively connected to said antenna elements, for amplifying receiving signals from said antenna elements;

phase control amount deciding means for deciding phase control amounts of said receiving signals corresponding to gains of said receiving amplifiers based on gain versus phase shift amount characteristics of said receiving amplifiers;

frequency offset controlling means for outputting a frequency offset correction value based on said decided phase control amount and a frequency offset signal; and phase shift amount correcting means for correcting phase shift amounts of said receiving signals in accordance with said frequency offset correction value.

The present invention provides a method of correcting a phase shift amount of a receiving signal, comprising the steps of:

obtaining gains of receiving amplifiers for amplifying receiving signals from a plurality of antenna element constituting an antenna array;

deciding phase control amounts of said receiving signals corresponding to the gains of said receiving amplifiers based on gain versus phase shift amount characteristics of said receiving amplifiers;

outputting a frequency offset correction values based on said decided phase control amounts and a frequency offset signal; and correcting the phase shift amounts of said receiving signals in accordance with said frequency offset correction values.

DETAILED DESCRIPTION OF THE PREFERRED EMBODIMENTS

Hereinafter, preferred embodiments of the present invention will be concretely described with reference to the drawings.

(First Embodiment)

Figure 1:
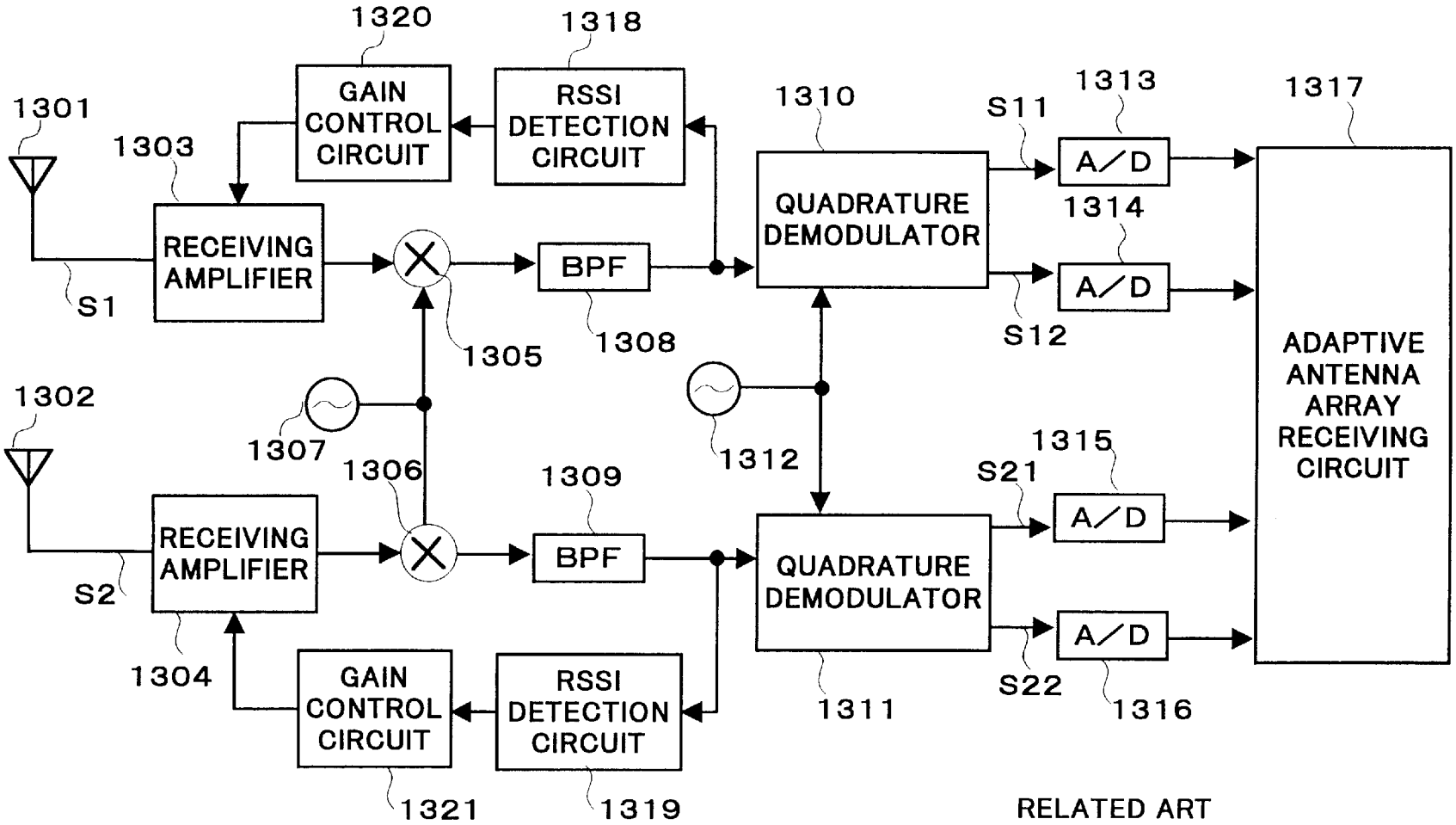
RELATED ART FIG.1
FIG. 1 is a block diagram showing a conventional antenna array receiver.
Figure 2:
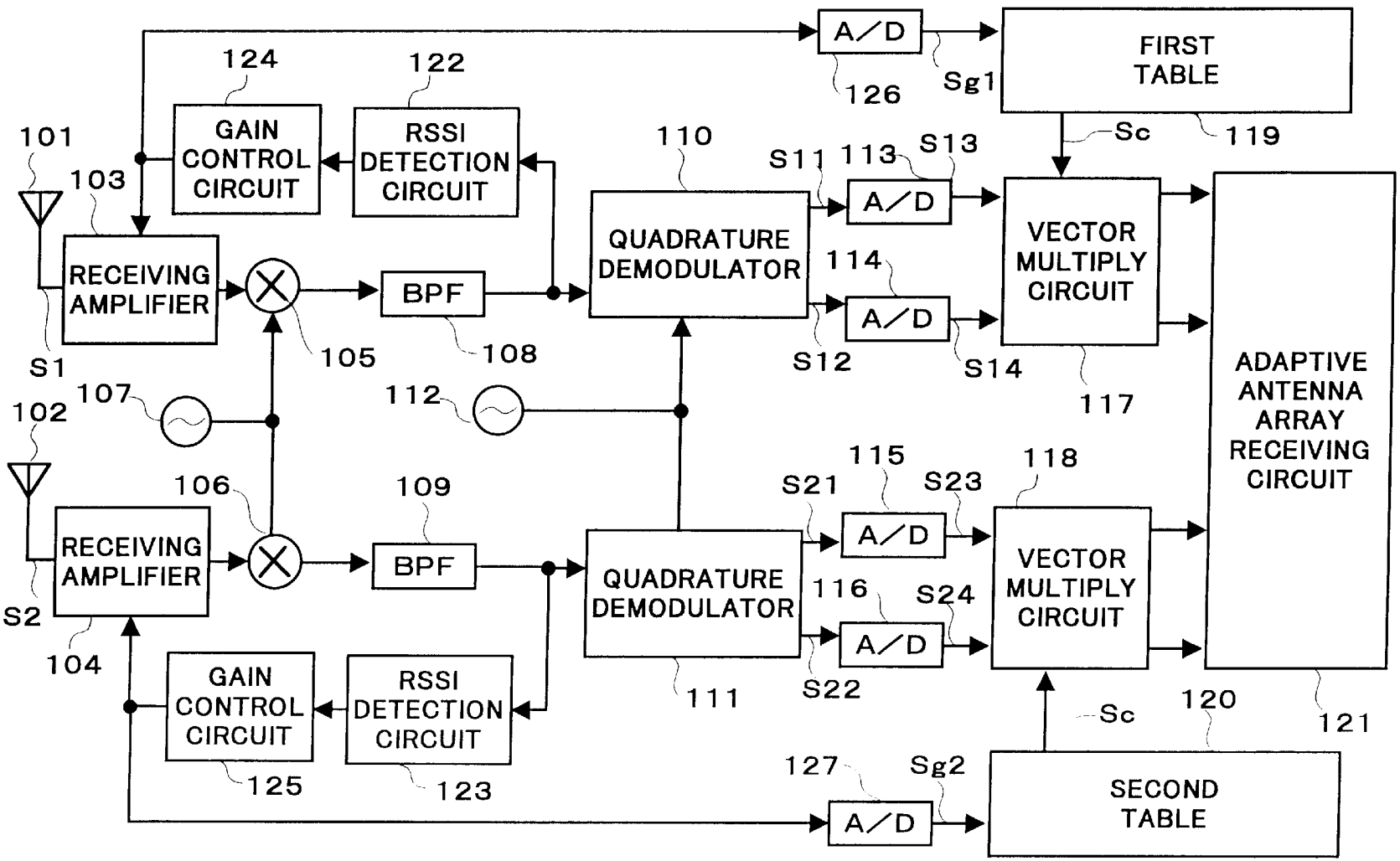
FIG. 2 is a block diagram showing an antenna array receiver according to a first embodiment of the present invention.

FIG. 2 is a block diagram showing an antenna array receiver according to a first embodiment of the present invention. While the number of antennas is two for ease of explanation, the basic operation is the same when the number of antennas is more than three.

First, receiving signals S1 and S2 at first and second antennas 101 and 102 are amplified by receiving amplifiers 103 and 104. Then, the signals are multiplied by a signal from an oscillator 107 by mixers 105 and 106 and a lower-frequency signal is extracted by band-pass filters (hereinafter, referred to as BPFs) 108 and 109. At quadrature demodulators 110 and 111, quadrature demodulation is performed by use of a signal from an oscillator 112, and in-phase components S11 and S21 and quadrature components S21 and S22 are output. These output signals are converted into digital values by A/D converters 113, 114, 115 and 116. The results are input to vector multiply circuits 117 and 118. The vector multiply circuits 117 and 118 shift the phases of input signals S13, S14, S23 and S24 in accordance with control signals SC1 and SC2 from phase control amount tables 119 and 120 and outputs the phase-shifted signals to an adaptive antenna array receiving circuit 121.

At RSSI detect circuits 122 and 123, the lower-frequency signal extracted by the BPFs 108 and 109 is monitored and the levels of the receiving signals are detected. In accordance with the receiving signal levels, the gains of the receiving amplifiers 103 and 104 are controlled by gain control circuits 124 and 125.

The gain control signals are simultaneously converted into digital values by A/D converters 126 and 127 and input to the first and second phase control amount tables (referred to as First table and Second table in the figures) 119 and 120, respectively. At the phase control amount tables 119 and 120, phase control signals Sc1 and Sc2 are output to the vector multiply circuits 117 and 118. The phase control signals Sc1 and Sc2 represent phase shift amounts corresponding to the gains represented by gain control signals Sg1 and Sg2 as arguments.

Figure 3:
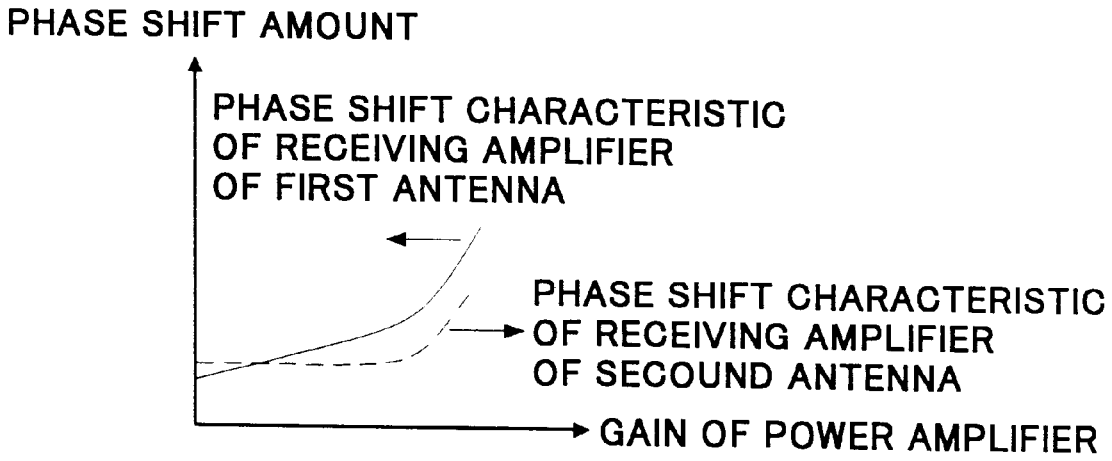
FIG. 3 is a view showing gain versus phase shift amount characteristics in the first embodiment.

In the phase control amount tables 119 and 120, previously measured gain versus phase shift amount of the receiving amplifiers are stored. FIG. 3 is a view showing the gain versus phase shift amount characteristics of the receiving amplifiers. The solid line represents the gain versus phase shift amount characteristic of the receiving amplifier of the first antenna 101. The broken line represents the gain versus phase shift amount characteristic of the receiving amplifier of the second antenna 102.

In the phase control amount tables 119 and 120, the characteristics are stored with the gains as the arguments. Since there are n receiving amplifiers when there are n antennas in practice, the characteristic of each amplifier is previously measured and stored in the table.

Thus, the amount of phase shift cause mainly by the receiving amplifier in each antenna are corrected in correspondence with the gain control amount responsive to the receiving signal level. Therefore, the receiving signals can be input to the adaptive antenna array receiving circuit 121 with the phase difference at the antenna terminals being maintained.

Herein, on the basis of a difference of phase shift amount produced by a difference of the channel length from each of the first and second antennas 101 and 102 to input terminal of vector multiply circuits 117 and 118, that is, A/D converters 113, 114, 115 and 116, the determined phase shift control amount may be corrected. For example, (d−b) is obtained by comparing a receiving signal a×exp(jb) at the end part of the channel at the first and second antennas 101 and 102 side with a receiving signal c×exp(jb) before the A/D converters 113 through 116. This value of (d−b) is a phase shift amount from the first antennas 101 and 102 to the A/D converters 113, 114, 115 and 116. Therefore, the phase shift control amount determined above is corrected on the basis of the value of (d−b).

(Second Embodiment)

Figure 4:
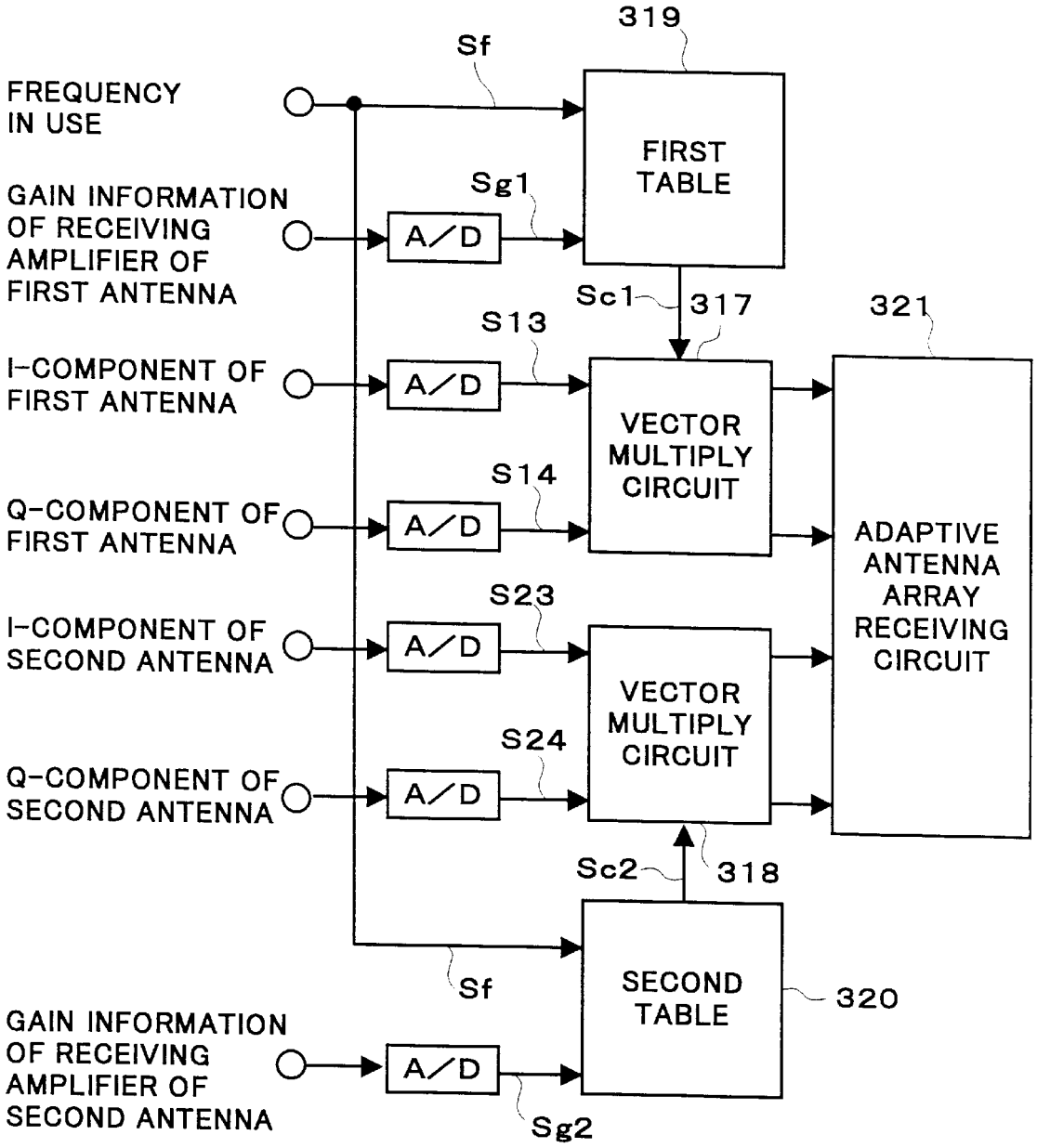
FIG. 4 is a block diagram showing a relevant part of an antenna array receiver according to a second embodiment.

FIG. 4 is a block diagram showing a relevant part of an antenna array receiver according to a second embodiment of the present invention. In the figure, for ease of explanation, the antenna terminals and the receiving RF portion are omitted from the block of the antenna array receiver shown in FIG. 2.

In the first embodiment, by correcting the phase shift amount for the control gain of each receiving amplifier, signals are input to the adaptive antenna array receiving circuit with the receiving phase difference at the antenna terminals being maintained.

However, normally, one carrier frequency is selected for use from among a plurality of carrier frequencies. For this reason, the phase shift amounts of the receiving amplifiers vary also according to the frequency. Therefore, in the second embodiment, the correction of the phase shift amount is performed also with respect to the frequency in use.

Figure 5A:
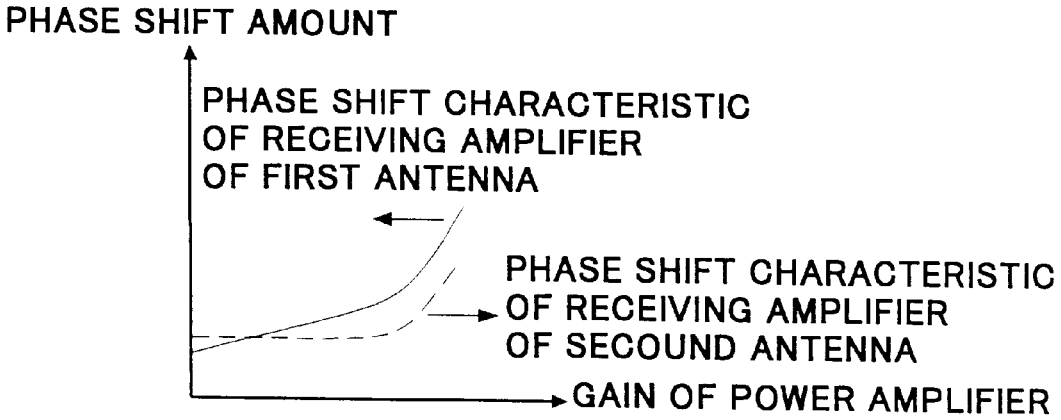
FIGS. 5A and 5B are views showing gain versus phase shift amount characteristics in the second embodiment.
Figure 5B:
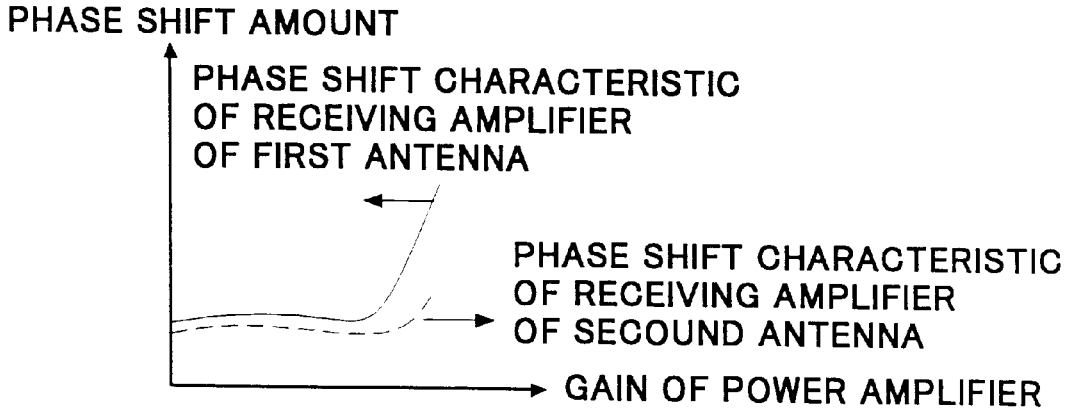

First, as shown in FIGS. 5A and 5B, the gain versus phase shift amount characteristic of each of the receiving amplifiers of the first and second antennas 101 and 102 is measured with respect to each of frequencies f1 and f2 in use, and the measured characteristics are stored in first and second phase control amount tables 319 and 320. Consequently, in the first phase control amount table 319, the gain versus phase shift amount characteristic of the receiving amplifier of the first antenna 101 is stored. Also, in the second phase control amount table, the gain versus phase shift amount characteristic of the receiving amplifier of the second antenna 102 is stored.

As the arguments, the gain control signals Sg1 and Sg2 of the receiving amplifiers and a frequency-in-use signal Sf are input to the phase control amount tables 319 and 320 to obtain the phase control signals Sc1 and Sc2 representative of phase shift amounts. At vector multiply circuits 317 and 318, the phases of the in-phase components S13 and S23 and the quadrature components S14 and S24 of the first and second antennas 101 and 102 are shifted in opposite directions in accordance with the phase control signals Sc1 and Sc2.

According to the second embodiment, by previously measuring the gain versus phase shift amount with respect to each frequency in use, signals can be input to an adaptive antenna array receiving circuit 321 with the phase difference at the antenna terminals being maintained with respect to all the frequencies in use.

Furthermore, as in the first embodiment, the determined phase shift control amount may be corrected on the basis of the difference of phase shift amount produced by the difference of channel length.

(Third Embodiment)

Figure 6:
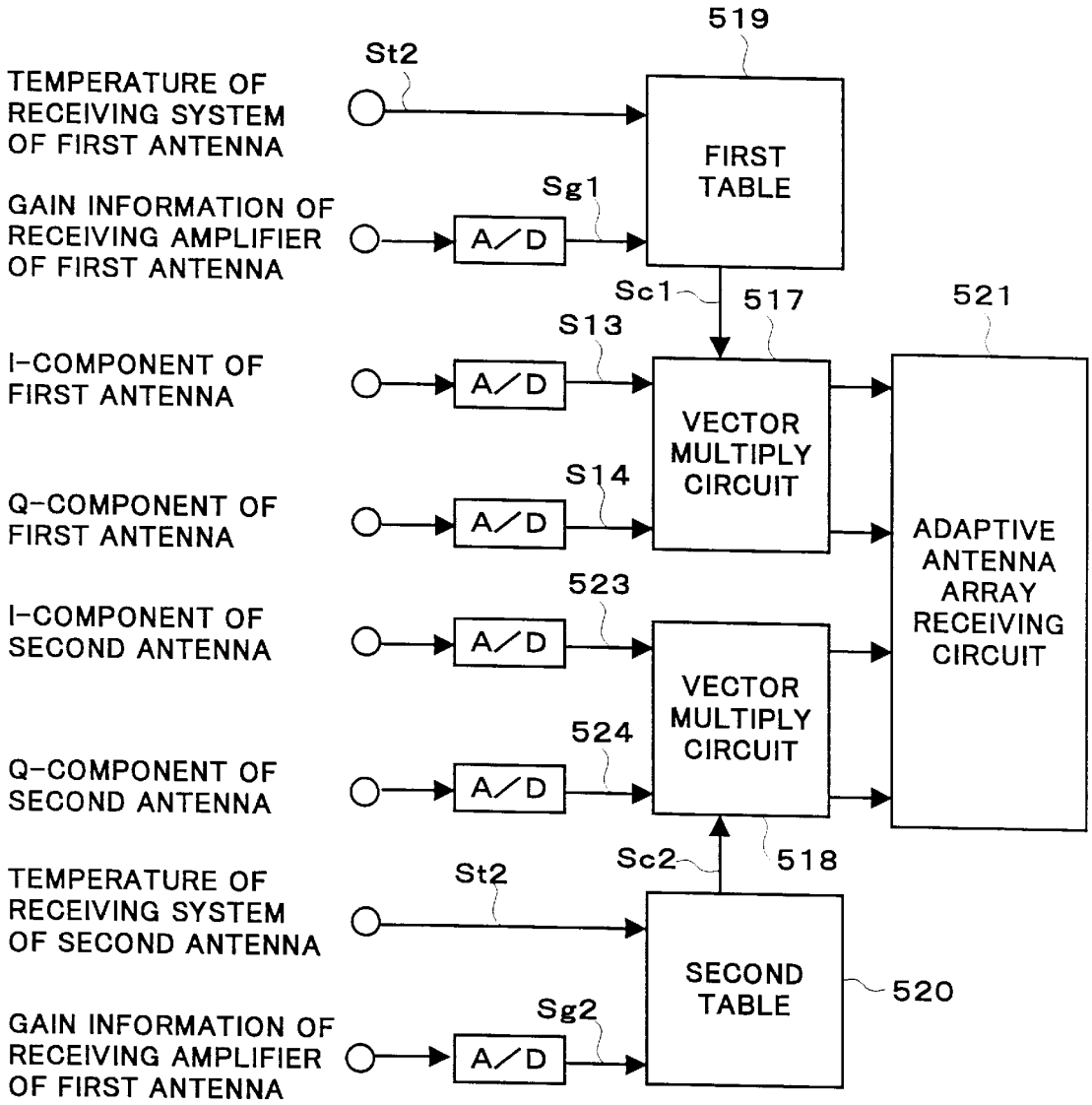
FIG. 6 is a block diagram showing a relevant part of an antenna array receiver according to a third embodiment of the present invention.

FIG. 6 is a block diagram showing a relevant part of an antenna array receiver according to a third embodiment of the present invention. Like in the second embodiment, the antenna terminals and the receiving RF portion are omitted for ease of explanation.

In the third embodiment, the phase shift amount is controlled in consideration of the operating temperatures of the receiving amplifiers. In the antenna array receiver of the present invention which is used as a part of a normal transmitter/receiver, the transmit RF portion is high in temperature because the power consumption is great. Since the phase shift amount sometimes varies according to the temperature in some receiving amplifiers, it is desirable to perform the correction of the phase shift amount with respect to the temperature variation of the receiving amplifiers by use of the gain versus phase shift amount characteristic table for each temperature.

Figure 7A:
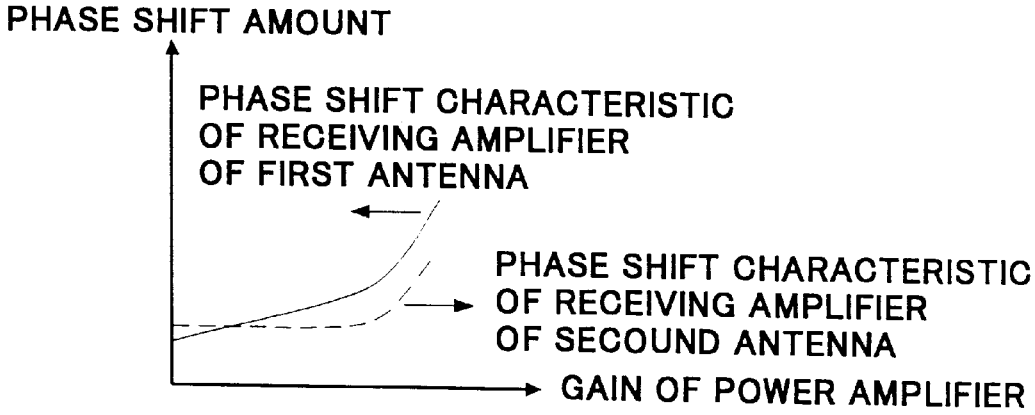
FIGS. 7A and 7B are views showing gain versus phase shift amount characteristics in the third embodiment.
Figure 7B:
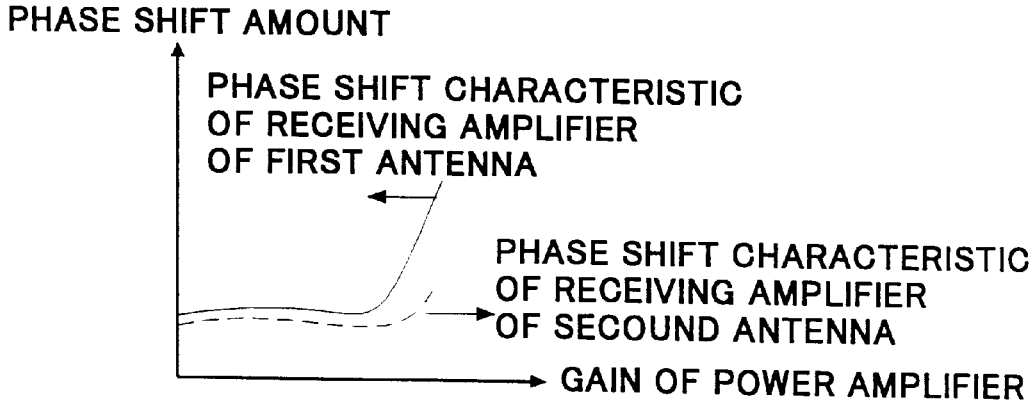

First, as shown in FIGS. 7A and 7B, the gain versus phase shift amount characteristic of each of the receiving amplifiers of the first and second antennas 101 and 102 is measured with respect to each of operating temperatures T1 and T2, and the measured characteristics are stored in first and second phase control amount tables 519 and 520.

As the arguments, the gain control signals Sg1 and Sg2 of the receiving amplifiers and operating temperature signals St1 and St2 are input to the phase control amount tables 519 and 520 to obtain the phase control signals Sc1 and Sc2 representative of phase shift amounts. At vector multiply circuits 517 and 518, the phases of the in-phase components S13 and S23 and the quadrature components S14 and S24 of the first and second antennas 101 and 102 are shifted in opposite directions in accordance with the phase control signals Sc1 and Sc2.

According to the third embodiment, by previously measuring the gain versus phase shift amount characteristic with respect to each temperature of amplifier, signals can be input to an adaptive antenna array receiving circuit 521 with the phase difference at the antenna terminals being maintained with respect to all the temperatures.

Furthermore, as in the first embodiment, the determined phase shift control amount may be corrected on the basis of the difference of phase shift amount produced by the difference of channel length.

(Fourth Embodiment)

Figure 8:
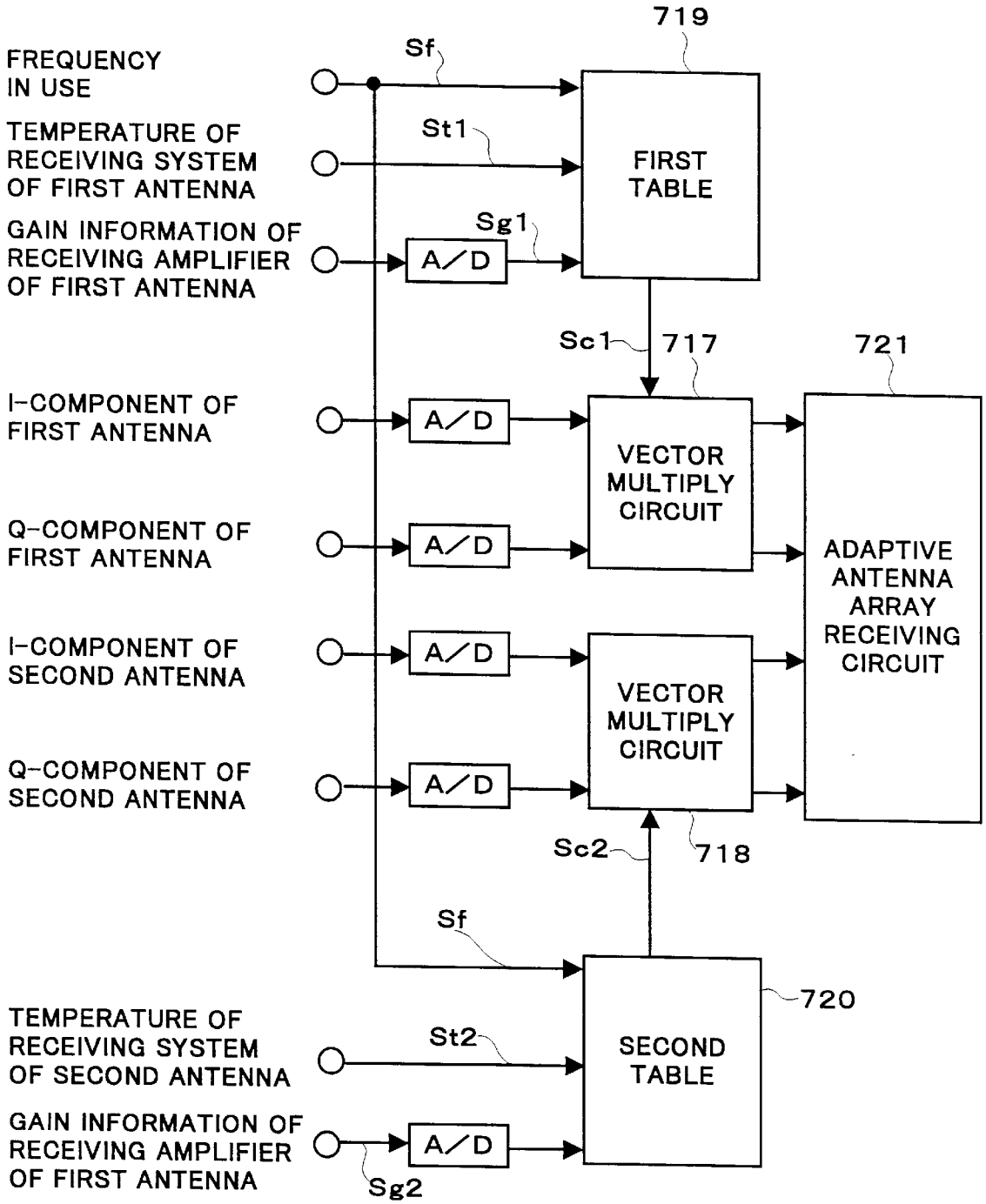
FIG. 8 is a block diagram showing a relevant part of an antenna array receiver according to a fourth embodiment of the present invention.

FIG. 8 is a block diagram showing a relevant part of an antenna array receiver according to a fourth embodiment of the present invention. Like in the third embodiment, the antenna terminals and the receiving RF portion are omitted for ease of explanation.

In the fourth embodiment, the correction of the phase shift amount is performed in consideration of both the frequency and the temperature in use by use of a table of the gain versus phase shift amount characteristic for each of the frequency and the temperature in use.

Figure 9A:
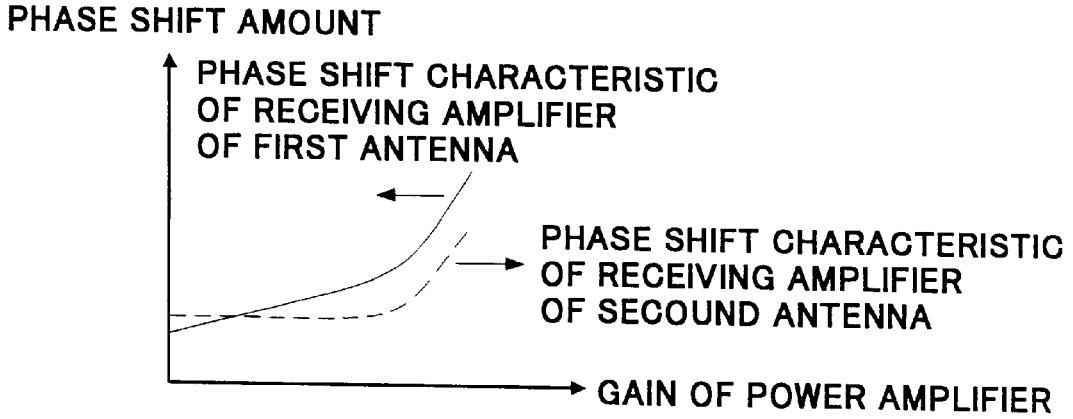
FIGS. 9A to 9D are views showing gain versus phase shift amount characteristics in the fourth embodiment.
Figure 9B:
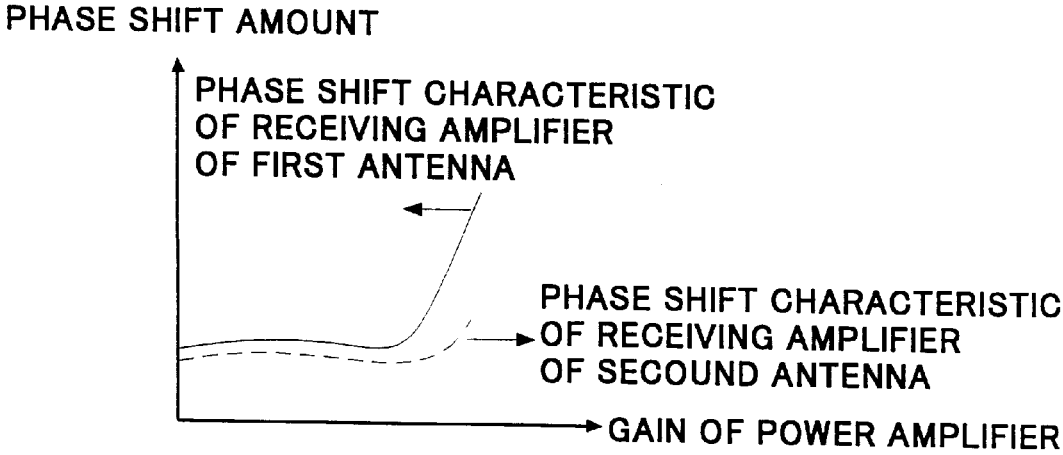
Figure 9C:
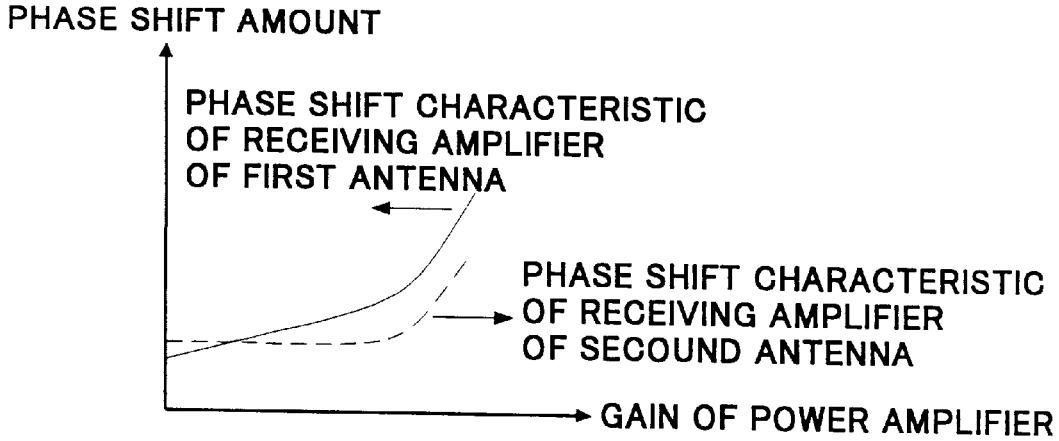
Figure 9D:
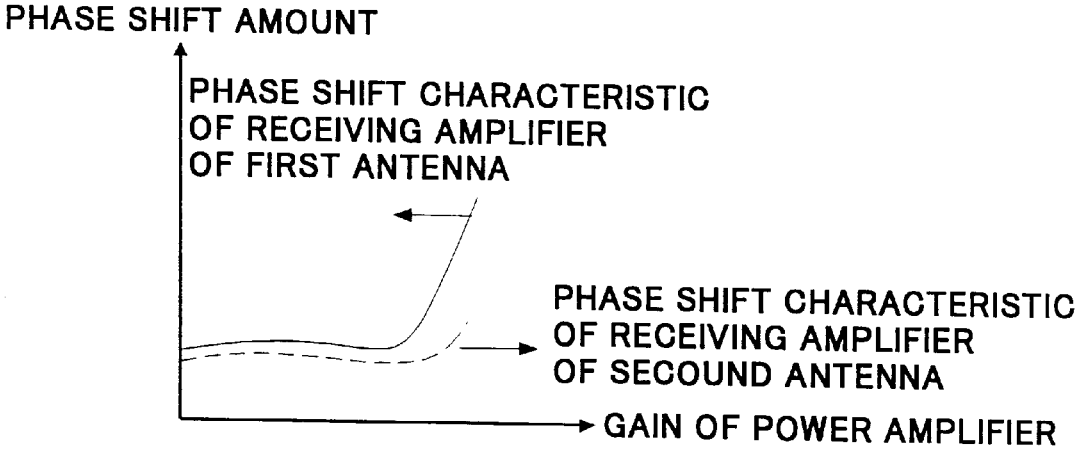

First, the gain versus phase shift amount characteristic is measured with respect to each frequency in use and each temperature. For example, as shown in FIGS. 9A and 9B, four kinds of gain versus phase shift amount characteristics are measured with combinations of two kinds of frequencies (f1 and f2) and two kinds of temperatures (T1 and T2), and the characteristics of the receiving amplifiers 103 and 104 of the antennas 101 and 102 are stored in first and second phase control amount tables 719 and 720.

As the arguments, the gain signals Sg1 and Sg2 of the receiving amplifiers 103 and 104, the frequency-in-use signal Sf and the operating temperature signals St1 and St2 are input to the phase control amount tables 719 and 720 to obtain the phase control signals Sc1 and Sc2 representative of phase shift amounts. At vector multiply circuits 717 and 718, the phases of the in-phase components S13 and S23 and the quadrature components S14 and S24 of the antennas 101 and 102 are shifted in opposite directions in accordance with the phase control signals Sc1 and Sc2.

According to the fourth embodiment, by previously measuring the gain versus phase shift amount characteristic with respect to each frequency and temperature in use, signals can be input to an adaptive antenna array receiving circuit 721 with the phase difference at the antenna terminals being maintained with respect to all the frequencies and temperatures in use.

Furthermore, as in the first embodiment, the determined phase shift control amount may be corrected on the basis of the difference of phase shift amount produced by the difference of channel length.

(Fifth Embodiment)

Figure 10:
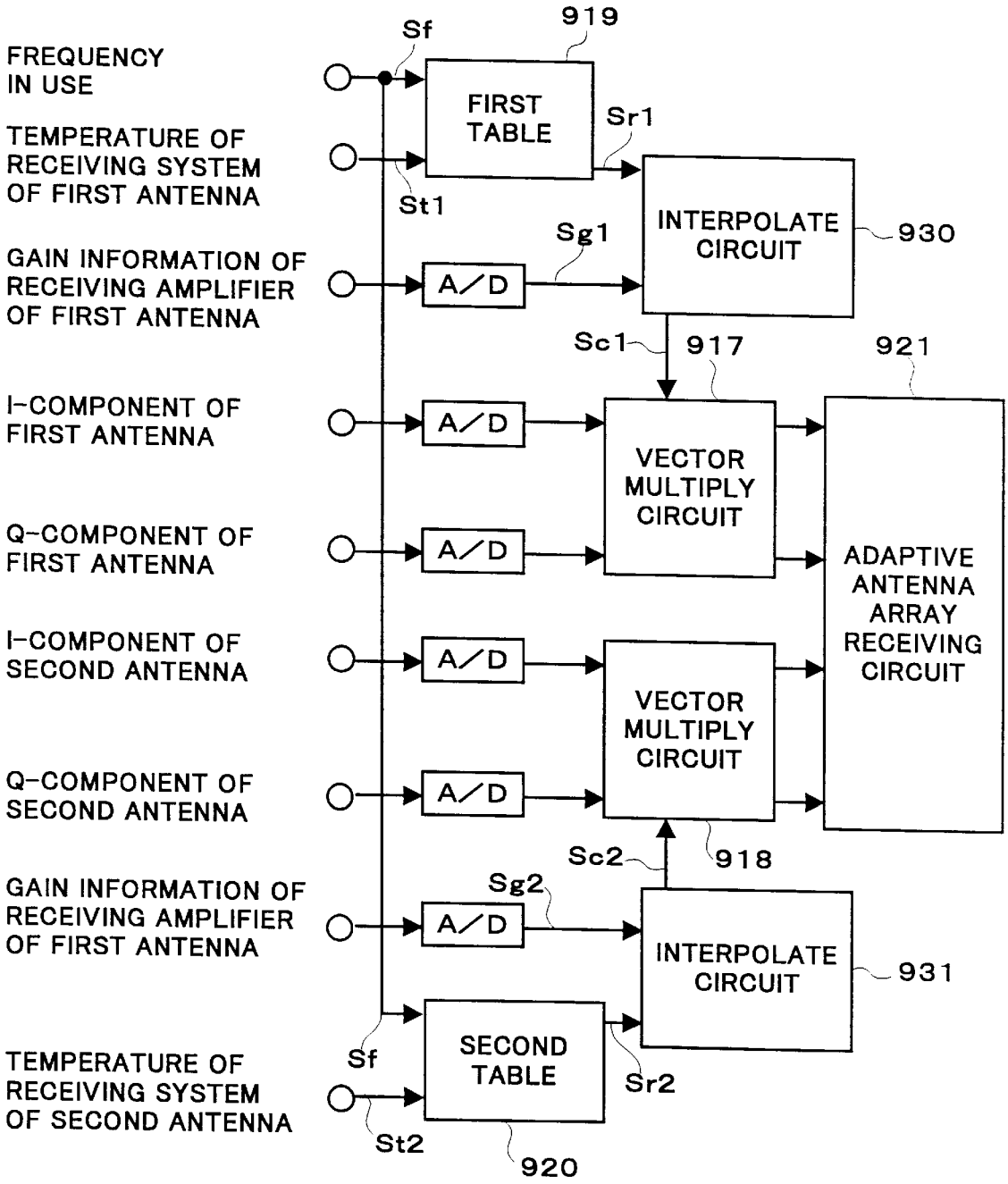
FIG. 10 is a block diagram showing a relevant part of an antenna array receiver according to a fifth embodiment of the present invention.

FIG. 10 is a block diagram showing a relevant part of an antenna array receiver according to a fifth embodiment of the present invention. Like in the fourth embodiment, the antenna terminals and the receiving RF portion are omitted for ease of explanation.

In the fourth embodiment, by correcting the phase shift amounts for the gains of the receiving amplifier with respect to each frequency and temperature in use, signals are input to the adaptive antenna array receiving portion with the receiving phase difference at the antenna terminals being maintained. However, an enormous amount of table are necessary when kinds of frequencies in use and estimated temperature environments increase.

Therefore, in the fifth embodiment, several characteristics are measured with respect to the frequency and temperature in use, and based on the several data, the phase shift amount for a necessary gain is calculated through interpolation.

Figures 11, 12:
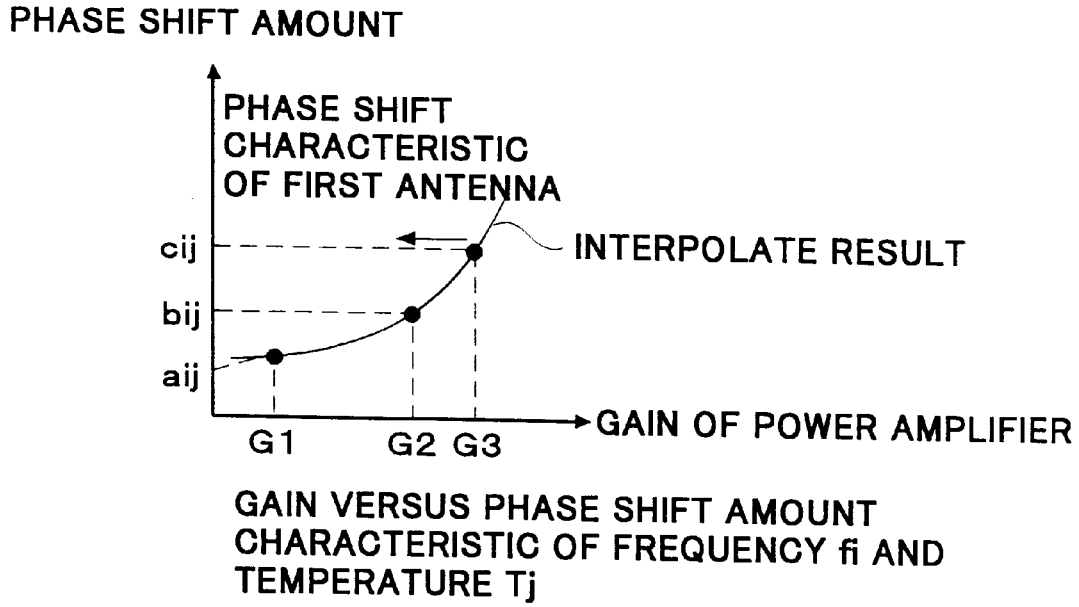
FIG. 11 is a view showing gain versus phase shift amount characteristics in the fifth embodiment.
FIG. 12 is a view showing gain versus phase shift amount characteristics in the fifth embodiment.

First, as shown in FIG. 11, several gain versus phase shift amount characteristics are measured with respect to each frequency and temperature in use. As an example, as shown in FIG. 12, with respect to four kinds of gain versus phase shift amount characteristics consisting of combinations of two kinds of frequencies (f1 and f2) and two kinds of temperatures (T1 and T2), a phase shift amount aij (i represents a frequency number and j represents a temperature number) for a gain G1, a phase shift amount bij for a gain G2 and a phase shift amount cij for a gain G3 are measured, and the characteristic of the receiving amplifier 103 and the characteristic of the receiving amplifier 104 are stored in phase control amount tables 919 and 920, respectively.

With respect to a signal processing system of the first antenna 101, the frequency-in-use signal Sf and the temperature St1 are input to the first phase control amount table 919 as the arguments to obtain a phase shift amount vector (aij, bij and cij).

A signal Sr1 representative of the phase shift amount vector and the gain signal Sg1 of the receiving amplifier are input to an interpolate circuit 930, and the phase control signal Sc1 corresponding to the gain signal Sr1 of the receiving amplifier is calculated. At a vector multiply circuit 917, the phases of the in-phase component S13 and the quadrature component S14 of the first antenna 101 are shifted in opposite directions by use of the phase control signal Sc1.

Likewise, wit respect to a signal processing system of the second antenna 102, the frequency-in-use signal Sf and the temperature St2 are input to the second phase control amount table 920 as the arguments to obtain a phase shift amount vector (aij, bij and cij).

A signal Sr2 representative of the phase shift amount vector and the gain signal Sg2 of the receiving amplifier are input to an interpolate circuit 931 and the phase control signal Sc2 corresponding to the gain signal Sg2 of the receiving amplifier is calculated. At a vector multiply circuit 918, the phases of the in-phase component S23 and the quadrature component S24 of the second antenna 102 are shifted in opposite directions by use of the phase control signal Sc2.

According to the fifth embodiment, by measuring several characteristics with respect to the frequency in use and the temperature and calculating the phase shift amount for a necessary gain through interpolation based on several pieces of data, signals can be input to adaptive antenna array receiving circuit 921 with the phase difference at the antenna terminals being maintained with respect to all the frequencies in use and temperatures with a small memory amount.

(Sixth Embodiment)

Figure 13:
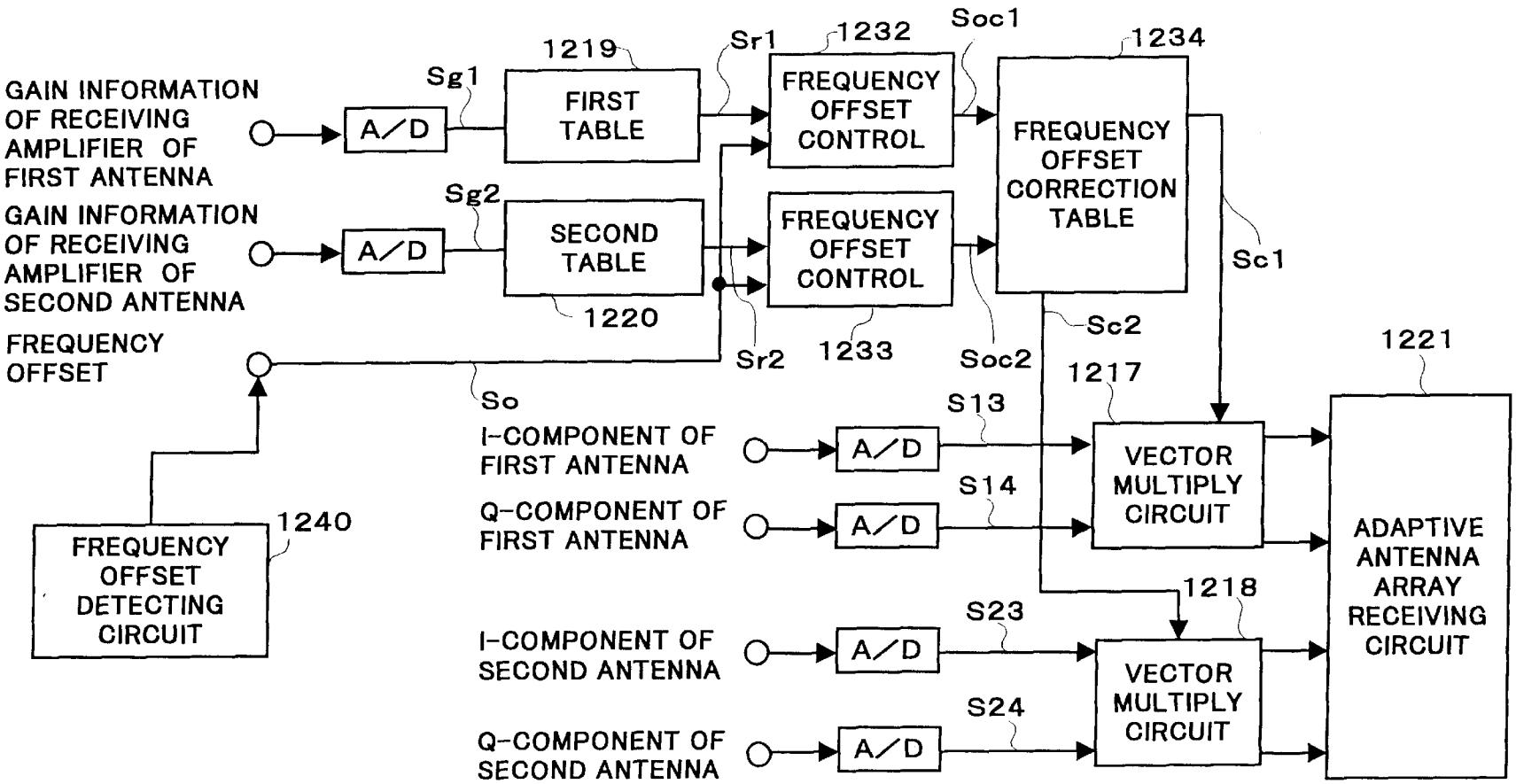
FIG. 13 is a block diagram of a relevant part of an antenna array receiver according to a sixth embodiment of the present invention.

FIG. 13 is a block diagram showing an antenna array receiver according to a sixth embodiment of the present invention. Like in the fifth embodiment, the antenna terminals and the receiving RF portion are omitted for ease of explanation.

In the first to fifth embodiments, by correcting the phase shift amount for the gain of the receiving amplifier with respect to environment including the frequency-in-use and the temperature, signals are input to the adaptive antenna array receiving circuit with the receiving phase difference at the antenna terminals being maintained.

However, in normal receivers, AFC (automatic frequency control) processing is performed in order to correct the difference between the frequency of the transmitter and the frequency of the receiver. The sixth embodiment is considered to effectively perform both the correction of the amount of phase shift caused by the receiving amplifiers and the AFC processing.

The gain Sg1 of the receiving amplifier of the signal processing system of the first antenna is input to a phase control amount table 1219, and the signal Sr1 representative of the phase shift amount vector is set to a frequency offset control circuit 1232. At the frequency off set control circuit 1232, a frequency offset correction table 1234 is searched by use of a frequency offset signal So and the signal Sr1, and the phase control signal Sc1 corresponding to a frequency offset correction value Soc1 is output. At a vector multiply circuit 1217, the phases of the in-phase component S13 and the quadrature component S14 of the first antenna are shifted in opposite directions in accordance with the phase control signal Sc1.

In the signal processing system of the second antenna, similar signal processing is performed. The gain Sg2 of the receiving amplifier of the signal processing system of the second antenna is input to a phase control amount table 1220, and the signal Sr2 representative of the phase shift amount vector is set to a frequency offset control circuit 1233. At the frequency offset control circuit 1233, a frequency offset correction table 1234 is searched by use of a frequency offset signal So and the signal Sr2, and the phase control signal Sc2 corresponding to a frequency offset correction value Soc1 is output. At a vector multiply circuit 1218, the phases of the in-phase component S23 and the quadrature component S24 of the second antenna are shifted in opposite directions in accordance with the phase control signal Sc2.

Thereafter, the in-phase components S13, S23 and the quadrature components S14, S24, which are shifted as described above, are input to the adaptive antenna array receiving circuit 1221

Herein, frequency offset signal So is obtained by a frequency offset detecting circuit 1240 which carries out the following calculations.

A transmission signal tx(kT)=a(kT)×exp(i θ(kT)) is transmitted. Herein, it is assumed that symbol time interval is T. In a case where a frequency offset exists, a receiving signal is as shown in the following equation.

$$rx(kT)=b(kT)\times exp(i\theta(kT))\times exp(j(k\delta+\beta)) \quad (1)$$

wherein a(kT) is an amplitude of time kT, θ(kT) is a phase of time kT, b(kT) is an amplitude fluctuation on the line, δ is a phase change amount in time T interval, and β is the initial phase of a receiver.

In the abovementioned equation (1), it is assumed that the time in which an already-known signal pattern is transmitted between a transmitter and a receiver is known. In other words, the receiver knows a(kT)×exp(iθ(kT)). Therefore, receiving signal rx(kT) is multiplied by a complex conjugate of the already-known signal, thereby obtaining the following equation (2).

$$x(kT)=rx(kT)\times\{a(kT)\times exp(j\theta(kT))\}\hat{}^{*}=a(kT)\times b(kT)\times exp\ (j(k\delta+\beta)) \quad (2)$$

wherein {.}^* shows a complex conjugate calculation.

Furthermore, wherein x(kT) is complex-multiplied at one symbol time interval, the following equation (3) is obtained.

$$y(kT)=x(kT)\times\{x((k-1)T)\}\hat{}^{*}=a(kT)\times a((k-1)T)\times b(kT)\times b((k-1)T)\times exp\ (j\delta) \quad (3)$$

wherein {.}^* shows a complex conjugate calculation.

As a result, the frequency offset component δ at one symbol time interval is calculated.

The calculation of the frequency offset correction values Soc1 and Soc2 are performed, specifically, in the following manner:

With the phase shift amount (φ1) as the initial value, a phase shift amount integration value (nθ+φ1 where θ is the phase shift amount and n is a symbol number) is calculated every symbol time based on the frequency offset per symbol time. sin((nθ+φ1)%2π) and cos((nθ+φ1)%2π) corresponding to the phase shift amount integration value are detected through the search of the table. The output result is the frequency offset correction value Soc1 and is output to the vector multiply circuit as the phase control signal Sc1.

Here, % is a modulo arithmetic. While sin((nθ+φ1)%2π) and cos((nθ+φ1)%2π) are calculated with reference to the frequency offset correction table in FIG. 13, they may be directly calculated by use of an approximate expression and the like without the use of the table.

According to the sixth embodiment, the two vector multiply circuits, namely the vector multiply circuit for the phase shift amount correction and the vector multiply circuit for the AFC processing can be reduced to one.

As is apparent from the above description in the first to sixth embodiments, by performing the correction of the phase shift amount for the gain of the receiving amplifier of each antenna, signals can be input to the adaptive antenna array receiving circuit with the phase difference at the antenna terminals being maintained.

The phase shift amount correction table may be provided for the frequency, for the temperature and for both the frequency and the temperature.

Moreover, in order to reduce the memory amount, the phase shift amount for the gain may be roughly set in advance so that the phase shift amount for a desired gain is calculated through interpolation processing based on the previously obtained value.

Further, by combining these configurations and the AFC processing, the two vector multiply circuits, namely the vector multiply circuit for the phase shift amount correction and the vector multiply circuit for the AFC processing can be reduced to one.

The antenna array receiver of the present invention described above is applicable to receivers for base stations and for mobile stations.

What is claimed is:

1. An antenna array receiver, comprising:

a plurality of antenna elements forming an antenna array;

receiving amplifiers, respectively connected to said plurality of antenna elements, that amplify receiving signals from said plurality of antenna elements;

phase control amount deciding means for determining phase control amounts of said receiving signals corresponding to gains of said receiving amplifiers, based on gain versus phase shift amount characteristics of said receiving amplifiers; and phase shift amount correcting means for correcting phase shift amounts of said receiving signals by use of the phase control amounts determined by said phase control amount deciding means.

2. The receiver of claim 1, further comprising:

means for supplying gain data of said receiving amplifiers to said phase control amount deciding device.

3. The receiver of claim 2, wherein said gain data supplying means comprises a gain controller that controls said gains of said receiving amplifiers.

4. The receiver of claim 1, wherein said phase shift amount deciding means obtains the gains of said receiving amplifiers from a gain controlling means for controlling the gain of said receiving amplifiers.

5. The receiver of claim 1, wherein said phase control amount deciding means has gain versus phase shift amount characteristics with respect to each frequency in use.

6. The receiver of claim 1, wherein said phase control amount deciding means has gain versus phase shift amount characteristics with respect to each receiving amplifier temperature.

7. The receiver of claim 1, wherein said phase control amount deciding means has gain versus phase shift amount characteristics of said receiving amplifiers with respect to each frequency and receiving amplifier temperature in use.

8. The receiver of claim 1, wherein said phase control amount deciding means has a table that holds phase control amounts corresponding to gains of said receiving amplifiers, said phase shift amount correcting means having a vector multiply circuit that phase-shifts receiving signals in accordance with phase control amounts obtained from said table and outputs said phase-shifted signals.

9. The receiver of claim 1, wherein said phase control amount deciding means comprises means for calculating, from two previously stored gain versus phase shift amount characteristic values, a gain versus phase shift amount characteristic value which is between said two previously stored gain versus phase shift amount characteristic values.

10. The receiver of claim 1, wherein said phase control amount deciding means comprises means for correcting decided phase control amounts based on differences in phase shift amounts between receiving signals due to differences in path length from said plurality of antenna elements to an input terminal of said phase shift amount correcting means.

11. A base station comprising the antenna array receiver according to claim 4.

12. A mobile station comprising the antenna array receiver according to claim 1.

13. A method of correcting a phase shift amount of a receiving signal, comprising:

obtaining gains of receiving amplifiers that amplify receiving signals from a plurality of antenna element forming an antenna array;

determining phase control amounts of the received signals corresponding to the gains of the receiving amplifiers, based on gain versus phase shift amount characteristics of the receiving amplifiers; and correcting a phase shift amount of the received signals using the determined phase control amounts.

14. The method of claim 13, wherein the gains of the receiving amplifiers are obtained by controlling the gains of the receiving amplifiers with gain controllers.

15. The method of claim 13, wherein phase control amounts of the received signals are determined with respect to each frequency in use based on gain versus phase shift amount characteristics.

16. The method of claim 13, wherein phase control amounts of the received signals are determined based on gain versus phase shift amount characteristics with respect to each receiving amplifier temperature.

17. The method of claim 13, wherein phase control amounts of the received signals are determined based on gain versus phase shift amount characteristics with respect to each frequency and receiving amplifier temperature in use.

18. The method of claim 13, wherein phase control amounts of the received signals are determined based on gain versus phase shift amount characteristic values calculated from two previously stored gain versus phase shift amount characteristic values, the gain versus phase shift amount characteristic values being between the two previously stored gain versus phase shift amount characteristic values.

19. The method of claim 13, wherein the decided phase control amounts are corrected based on differences in phase shift amounts between received signals due to differences in path length.

20. An antenna array receiver, comprising:

a plurality of antenna elements that form an antenna array;

receiving amplifiers, respectively connected to the plurality of antenna elements, for amplifying signals received by said plurality of antenna elements;

phase control amount deciding means for determining phase control amounts of said received signals corresponding to gains of said receiving amplifiers, based on gain versus phase shift amount characteristics of said receiving amplifiers; and phase shift amount correcting means for correcting phase shift amounts of said received signals based on offset control information of a frequency.

21. An antenna array receiver, comprising:

a plurality of antenna elements that form an antenna array;

receiving amplifiers, respectively connected to said plurality of antenna elements, that amplify signals received by said plurality of antenna elements;

phase control amount deciding means for determining phase control amounts of said received signals corresponding to gains of said receiving amplifiers, based on gain versus phase shift amount characteristics of said receiving amplifiers;

frequency offset controlling means for outputting a frequency offset correction value, based on said determined phase control amount and a frequency offset signal; and phase shift amount correcting means for correcting phase shift amounts of said received signals in accordance with said frequency offset correction value.

22. The receiver of claim 21, further comprising:

means for supplying gain data of said receiving amplifiers to said phase control amount deciding device.

23. The receiver of claim 22, wherein said gain data supplying means comprises a gain controller that controls said gains of said receiving amplifiers.

24. The receiver of claim 21, wherein said frequency offset controlling means comprises a table that holds said frequency offset correction value corresponding to a phase shift amount integration value, integrates said determined phase control amounts and said frequency offset signal to calculate said phase shift amount integration values, and outputs said frequency offset correction values corresponding to said calculated phase shift amount integration values in accordance with said table.

25. A method for correcting a phase shift amount of a received signal, comprising:

obtaining gains of receiving amplifiers that amplify signals received from a plurality of antenna elements that form an antenna array;

determining phase control amounts of said received signals corresponding to gains of said receiving amplifiers, based on gain versus phase shift amount characteristics of the receiving amplifiers;

outputting a frequency offset correction value, based on said determined phase control amounts and a frequency offset signal; and correcting phase shift amounts of said received signals in accordance with said frequency offset correction values.

26. The method of claim 25, wherein said determined phase control amounts and said frequency offset signal are integrated to calculate phase shift amount integration values, and said frequency offset correction values corresponding to said calculated phase shift amount integration values are output.

27. An antenna array receiver, comprising:

a plurality of antenna elements forming an array antenna;

receiving amplifiers, respectively connected to said plurality of antenna elements, that amplify signals received by said plurality of antenna elements;

gain data supplying means, connected to said receiving amplifiers, for supplying gain data of said receiving amplifiers; and phase shift amount correcting means for correcting phase shift amounts of said receiving signals, based on gain data from said gain data supplying means.

28. The receiver of claim 27, wherein said gain data supplying means comprises a gain controller that controls said gains of said receiving amplifiers.

29. The receiver of claim 27, wherein said phase control amount deciding means has gain versus phase shift amount characteristics with respect to each frequency in use.

30. The receiver of claim 27, wherein said phase control amount deciding means has gain versus phase shift amount characteristics with respect to each receiving amplifier temperature.

31. The receiver of claim 27, wherein said phase control amount deciding means has gain versus phase shift amount characteristics of said receiving amplifiers with respect to each frequency and receiving amplifier temperature in use.

32. The receiver of claim 27, wherein said phase control amount deciding means has a table that holds phase control amounts corresponding to gains of said receiving amplifiers, said phase shift amount correcting means having a vector multiply circuit that phase-shifts receiving signals in accordance with phase control amounts obtained from said table and outputs said phase-shifted signals.

33. The receiver of claim 27, wherein said phase control amount means device comprises means for calculating, from two previously stored gain versus phase shift amount characteristic values, a gain versus phase shift amount characteristic value which is between said two previously stored gain versus phase shift amount characteristic values.

34. The receiver of claim 27, wherein said phase control amount deciding means comprises means for correcting decided phase control amounts based on differences in phase shift amounts between receiving signals due to differences in path length from said plurality of antenna elements to an input terminal of said phase shift amount correcting means.

* * * * *